United States Patent [19]

Hohenhövel

[11] Patent Number: 4,524,714

[45] Date of Patent: Jun. 25, 1985

[54] PASTING MACHINE FOR A WEB OF MATERIAL, PREFERABLY WALLPAPER

[76] Inventor: Paul Hohenhövel, Meinstr. 114, D-3180 Wolfsburg 11, Fed. Rep. of Germany

[21] Appl. No.: 592,215

[22] Filed: Mar. 22, 1984

[51] Int. Cl.[3] ..... B05C 1/08

[52] U.S. Cl. ..... 118/123; 118/246; 118/261; 118/262; 118/DIG. 17

[58] Field of Search ..... 118/246, DIG. 17, 261, 118/262, 123, 102

[56] References Cited

U.S. PATENT DOCUMENTS 2,154,643 4/1939 Steren et al. ..... 118/246 X
2,264,501 12/1941 Beach ..... 118/DIG. 17
2,523,220 9/1950 Klesper ..... 118/246 X
2,565,319 8/1951 Newman ..... 118/407 X
2,774,330 12/1956 Schaefer ..... 118/261 X

*Primary Examiner*—John P. McIntosh
*Attorney, Agent, or Firm*—Jacobs & Jacobs

[57] ABSTRACT

A pasting machine having paste applicator roll, a feed roll rotated in a direction opposite to the direction of rotation of the applicator roll and a guide plate surrounding a circumferential region of the applicator roll, said guide plate taking up paste from the feed roll by means of a longitudinal edge facing the periphery of the feed roll and forcing said paste against the said circumferential region so as to uniformly coat the applicator roll with a layer of paste.

9 Claims, 2 Drawing Figures

PASTING MACHINE FOR A WEB OF MATERIAL, PREFERABLY WALLPAPER

The present invention relates to a pasting machine for web material, such as wall paper having a paste well, a paste applicator roll over said well arranged to be driven and contacted by the web of material over a portion of its circumference facing away from the well, the periphery of the paste applicator roll being uniformly coated with paste from the well and having guide rolls for the web of material. In known machines of this type, such as available on the market for the pasting of wallpaper, the applicator roll—which can be driven, for instance, by motor—dips directly into the supply of paste contained in the paste well. The thickness of the layer of paste on the applicator roll is defined by a scraper; the thickness of this layer also determines the thickness of the layer of paste on the wallpaper.

These known machines, however, operate properly only when pastes of relatively fluid consistency are used. Very viscous to paste-like pastes can, on the other hand, not be applied uniformly to the applicator roll uniformly over its entire circumference nor in the required rather small thickness of layer. Furthermore, corresponding difficulties arise in the region of the transfer of the paste from the applicator roll to the web of material to be coated and therefore, for instance, wallpaper.

The object of the present invention is to create a pasting machine for web material, such as wall paper, having a paste well, a paste applicator roll over said well arranged to be driven and contacted by the web of material over a portion of its circumference facing away from the well, the periphery of the paste applicator roll being uniformly coated with paste from the well, and having guide rolls for the web of material which operates reliably, regardless of the viscosity of the specific paste used.

The solution to this problem which is provided by the invention consists in the features set forth in the body of Claim 1; advantageous embodiments and further developments of the invention are set forth in the subordinate claims.

The use of the invention is not limited to the pasting of wallpaper, which as a rule is pulled off from a roll; the sole condition is that the web of material be capable of being wetted by paste and be so flexible that it adapts itself closely to a circumferential region of the applicator roll.

A preferred embodiment of the invention for the application of paste to wallpaper will be described below with reference to the drawing, in which.

Figure 2:
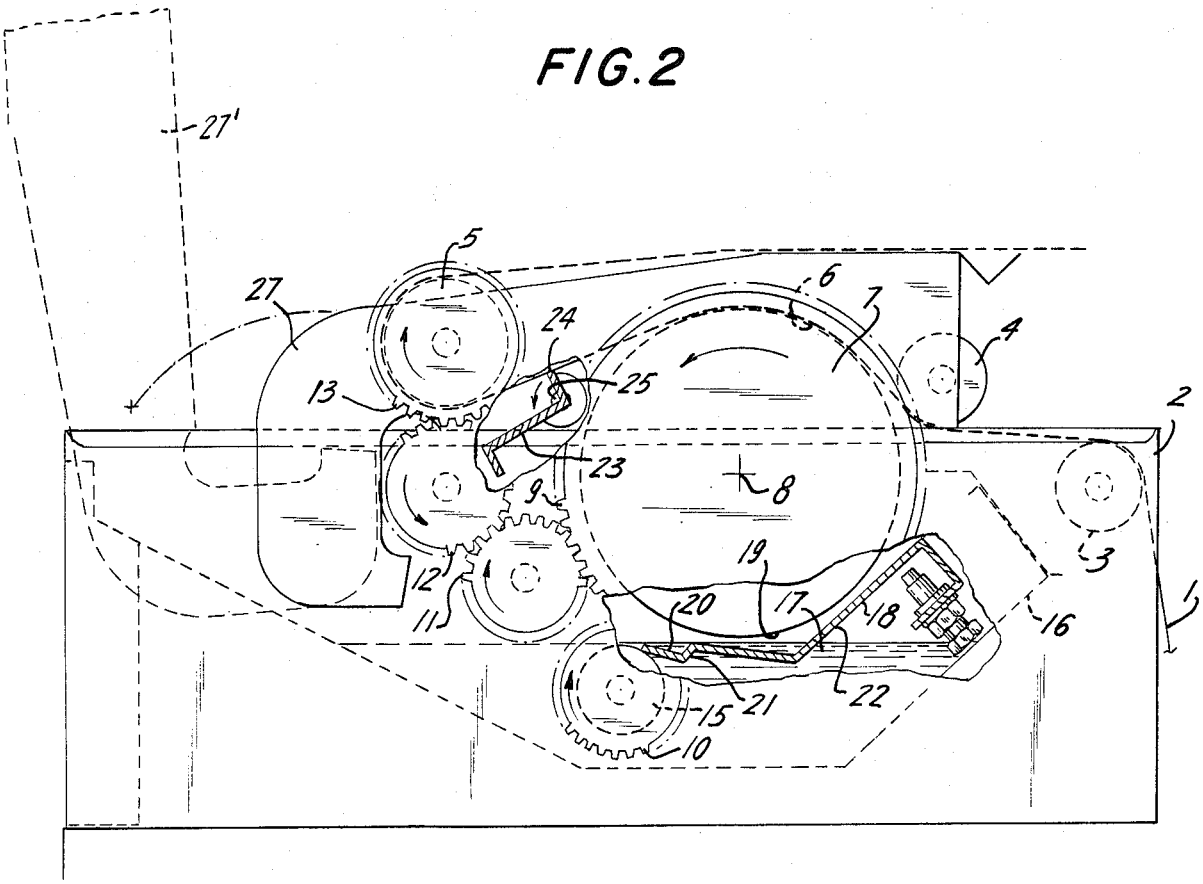
FIG. 2 is substantially a cross section.
Figure 1:
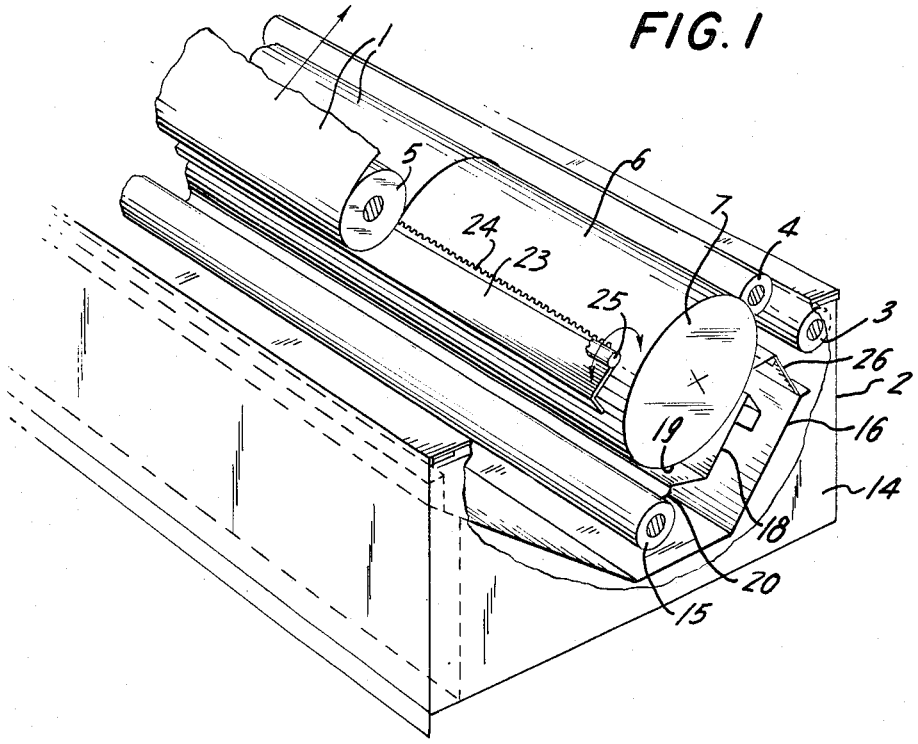
FIG. 1 is a perspective view.

The web of wallpaper which is pulled off from a wallpaper roll arranged below the machine is indicated at 1; the arrows symbolize the direction in which it is transported. By means of guide rolls 3, 4 and 5 mounted in the housing 2 of the machine, the wallpaper 1 is pulled against the region of the upper periphery 6 of the paste applicator roll 7 the roll rotating in operation around its axis of rotation 8 in counterclockwise direction, as indicated by the arrow. The drive is effected in known manner via an electric motor (not shown) which, via gears 9, 10, 11, 12 and 13 which are arranged in front of the side wall 14 of the housing 2 and thus outside of it, drives in synchronism both the applicator roll 7 and the guide roll 5 which operates as removal roll, as well as the paste feed roll 15, the latter being driven in clockwise direction. All rolls are arranged parallel to each other.

The paste well 16 which contains the supply of paste 17 which is visible only in FIG. 2 and into which the feed roll 15 extends, is arranged in the housing 2. The feed roll 15 has a considerably smaller diameter than the applicator roll 7 so that the transportation effected by it of even heavy, practically pasty pastes from the paste well 16 into the paste guide plate 18 requires only a relatively small drive torque. The paste guide plate 18, which surrounds at a distance, the lower circumferential region 19 of the applicator roll 7, removes paste, by means of its longitudinal edge 20, from the periphery of the feed roll 15 and forces it via, inclined surfaces 21 and 22 against the applicator roll 7.

Between applicator roll 7 and guide roll 5 the scraper comb 23 can be noted, below the wallpaper 1, within the vertical projection of the paste well 16 (so that paste which is scraped off drops into it), the serrated edge 24 of said comb assuring uniform and precise adjustment of the thickness of layer of the paste on wallpaper 1. In order to adjust for different layer thicknesses, the comb can be swung by hand into different positions around the shaft 25. The scraper comb is an inexpensive piece of sheet metal which, despite the fact that it extends over the entire width of the machine, possesses great stiffness due to its Z shaped cross section.

The scraper 26 which is fastened to the paste well 16 on its outlet side scrapes excess paste off from the applicator roll 7 and further assures a uniform thickness of the layer.

In order to facilitate the insertion of the wallpaper 1, the guide roll 5 can be swung up via lateral yokes (of which only the front yoke 27 is visible in FIG. 2 (yoke position 27'); the gears 12 and 13 thus come out of engagement with each other.

Due to the arrangement of the feed roll 15 close to the bottom of the paste well 16, it effects movement of the paste from right to left in FIG. 2 towards the "place of use," namely the longitudinal edge 20.

In conclusion it may be pointed out that by the expression "paste" there is understood any application material having an adhesive action, without regard to its composition.

I claim:

1. A pasting machine for a web of material (1), preferably wallpaper, having a paste well (16), a paste applicator roll (7) arranged in driveable manner over said well and contacted by the web of material (1) over a portion (6) of its circumference facing away from the paste well (16), the periphery of said applicator roll being uniformly coated with paste from the paste well (16), and having guide rolls (3, 4, 5) for the web of material (1) arranged on both sides of the applicator roll (7) and pulling the web of material (1) against the upper periphery (6) of the applicator roll (7), characterized by the fact that a paste well roll (15) which extends parallel to the applicator roll (7) and is driven in the direction of rotation opposite to that of the applicator roll (7) extends at least over a part of its periphery into the paste (17) in the paste well (16) and that a paste guide plate (18) is provided which surrounds, at a distance, a circumferential region (19) of the applicator roll (7) which is adjacent the feed roll (15), said guide plate (18) being adapted to force paste against said circumferential region (19) and by means of a longitudinal edge (20) facing the periphery of the feed roll (15) takes up paste from the feed roll (15), and that below the part of the web of material (1), which has moved away from the applicator roll (7) and at a distance from said part of the web which determines the thickness of the layer of paste on it, a scraper bar (23) is arranged within the vertical projection of the paste well (16).

2. A machine according to claim 1, wherein the scraper bar has a serrated scraper edge (24) as scraper comb (23).

3. A machine according to claim 1 wherein the scraper bar (23) is swingable around a shaft (25) in order to adjust its distance away.

4. A machine according to claim 1 wherein the scraper bar (23) is a sheet-metal part profiled as a beam in cross section.

5. A machine according to claim 1 wherein the feed roll (15) is of smaller diameter than the applicator roll (7).

6. A machine according to claim 1 comprising driving means (9, 10) to drive the feed roll (15) at least with the same circumferential velocity as the applicator roll (7).

7. A machine according to claim 1 wherein said feed and applicator rolls (15, 7) are coupled for driving by gearwheels (9, 10).

8. A machine according to claim 1 wherein a scraper (26) for removing excess paste is arranged behind the applicator roll (7) and the guide plate (18) as seen in operating direction.

9. A machine according to claim 1 wherein the guide plate (18) forms at least one inclined pressing surface (21, 22) for the paste.

* * * * *